United States Patent [19]

Yamashita et al.

[11] 4,192,140

[45] Mar. 11, 1980

[54] APPARATUS AND METHOD RELATING TO INTERNAL COMBUSTION ENGINES UTILIZING AN EXHAUST GAS REACTOR

[75] Inventors: Ryuichi Yamashita; Hiromitsu Matsumoto, both of Hamamatsu, Japan

[73] Assignee: Yamaha Hatsudoki Kabushiki Kaisha, Iwata, Japan

[21] Appl. No.: 501,856

[22] Filed: Sep. 3, 1974

[30] Foreign Application Priority Data

Jul. 16, 1974 [JP] Japan ..... 49-81553

[51] Int. Cl.[2] ..... F01N 3/14

[52] U.S. Cl. ..... 60/277; 60/285; 123/97 B; 123/119 DB; 123/124 R

[58] Field of Search ..... 60/285, 274, 277, 900; 123/97 B, 124 R, 119 DB, 119 R

[56] References Cited

U.S. PATENT DOCUMENTS

| | | | |
|---|---|---|---|
| 3,745,768 | 7/1973 | Zechnall | 60/285 |
| 3,768,787 | 10/1973 | Marsee | 60/900 |
| 3,782,346 | 1/1974 | Tatsutomi | 123/97 B |
| 3,795,230 | 3/1974 | Yoshimura | 123/97 B |
| 3,795,237 | 3/1974 | Denton | 123/97 B |
| 3,807,172 | 4/1974 | Masaki | 60/285 |
| 3,818,701 | 6/1974 | Foster | 60/285 |
| 3,824,788 | 7/1974 | Cole | 60/285 |
| 3,841,281 | 10/1974 | Mick | 123/97 B |
| 3,841,282 | 10/1974 | Rogerson | 123/97 B |
| 3,852,391 | 12/1974 | Hisatomi | 123/97 B |
| 3,916,622 | 11/1975 | Gospodar | 60/277 |

*Primary Examiner*—Douglas Hart
*Attorney, Agent, or Firm*—Donald D. Mon

[57] ABSTRACT

Apparatus and method for the protection of an exhaust gas reactor, for example a catalytic element or a thermal reactor, disposed in the exhaust conduit of an internal combustion engine which is operated on a lean air/fuel mixture. This invention provides means for protection of the exhaust gas reactor from excessive temperatures under deceleration conditions by regulating the air/fuel mixture ratio in the induction means of the engine whereby to restrict the oxidation which occurs at the reactor. One method according to the invention comprises adding supplementary air to the induction means for a limited time after the throttle is closed under deceleration conditions, and after an initial delay, adding supplementary fuel to the induction means while the engine continues to operate under deceleration conditions. In addition, thermally sensitive means responsive to the temperature of the exhaust gas reactor serves to maintain the air/fuel ratio of the mixture in the induction means at a relatively richer value whenever there is indication of overheating of the exhaust gas reactor.

13 Claims, 7 Drawing Figures

APPARATUS AND METHOD RELATING TO INTERNAL COMBUSTION ENGINES UTILIZING AN EXHAUST GAS REACTOR

This invention relates to four-cycle internal combustion engines operated on lean air/fuel mixtures and having an exhaust gas reactor in their exhaust means to oxidize unburned constituents of the fuel, and to means for operating the engine, so as to protect the exhaust gas reactor from thermal damage.

In internal combustion engines having exhaust gas reactors disposed in their exhaust system, unburned fuel constituents in the exhaust gases are oxidized to form innocuous substances. One common type of reactor is a thermal reactor that constitutes a chamber kept at a suitable temperature, and in which the exhaust gases reside for a sufficient time that the unburned constituents are oxidized. Still another known reactor is the catalytic type, wherein a catalyst element is disposed in the stream of exhaust gases where it promotes and catalyzes the oxidations.

Prior art systems have been devised to oxidize the unburned constituents, but they have involved considerable economic disadvantages. For example, for rich-running engines air injection systems are known for injecting air into the exhaust gases to provide sufficient oxygen for the process. The additional equipment and controls needed for this system are costly. They must be of high quality in order to provide a satisfactory life and reliability. In addition, their reactors are subject to thermal damage during deceleration, and therefore must be made more rugged and costly so as to resist this damage. For example, the materials for a thermal reactor useful in one well-known prior art system cost nearly five times as much as the simpler thermal reactor which can be used in this invention.

The use of a thermal reactor with an engine which is set to run on a lean mixture is known. It does have the disadvantage of a theoretical poor efficiency on cold starts. Also, in prior art systems of this type, the higher temperatures which were utilized required the more expensive construction.

It is an object of this invention to provide simple, reliable and relatively inexpensive means to enable an engine to operate effectively on a lean air/fuel mixture with a relatively inexpensive exhaust gas reactor having a long life. The term "exhaust gas reactor" is used herein to mean a catalytic element, or a thermal reactor which includes a residence chamber. This invention enables one to enjoy both the advantages of lean engine operation and the use of a catalytic element, which have heretofore been incompatible with each other, or of an inexpensive thermal reactor, which has heretofore not been practical.

There are substantial advantages in operating an internal combustion engine with mixtures which are not richer than stoichiometric, and especially with mixtures which are leaner than stoichiometric. A "stoichiometric mixture" is one in which, when the combustion is completed as far as the limiting substance (fuel or oxygen) permits, there will be neither excess oxygen nor excess fuel remaining. The numerical value of the "stoichiometric ratio" when gasoline is consumed is about 15; that is, the carburetor passes about 15 formula weights of air for every formula weight of gasoline introduced into the air stream. The term "fuel" as used herein means gasoline and similar liquid hydrocarbon fuels.

Leaner mixtures have a relatively larger numerical value of their air/fuel ratio and have excess oxygen. "Lean mixtures" are here defined as mixtures with an air/fuel ratio greater than the stoichiometric. The term "ratio" is sometimes used interchangeably with its numerical value. In contrast, richer mixtures have a relatively smaller air/fuel ratio. "Rich mixtures" are here defined as mixtures with an air/fuel ratio lesser than stoichiometric. There is insufficient oxygen in a rich mixture to consume all of its fuel.

During normal operation of an engine on a lean mixture, the exhaust gas contains residual oxygen. Under these conditions, it is unnecessary to supply additional air to the exhaust system for oxidizing the unburned constituents in the exhaust gas. Furthermore, the amount of unburned constituents in the exhaust gas from an internal combustion engine which is operated with a lean mixture is generally small. Therefore, a relatively small thermal load is imposed on the reactor, and heat generation in the reactor can be maintained at a low level. Durability of the catalyst in a catalytic reactor, or of the shell of a thermal reactor, is thereby significantly improved as contrasted with rich-mixture operation where supplementary oxygen is added in the exhaust system and the oxidation occurs in the reactor, where the generated heat imposes a very substantial thermal stress on the reactor which increases its cost and reduces its durability. The foregoing favorable situation pertains in "normal" conditions, which conditions are defined as those which do not involve acceleration, deceleration, starting, or operation under heavy load.

However, when decelerating an engine that is provided with fuel-supplying means such as a carburetor, or with a fuel injector, set to deliver a lean mixture under normal conditions, circumstances occur which produce exhaust gases that can subject the reactor to an unacceptable thermal overload. A principal cause of such an overload is misfiring, wherein the charge is not consumed in the combustion chamber, but instead flows unoxidized to the reactor, where it oxidizes and can create a thermal overload. The term "deceleration conditions" as used herein is inclusive of typical slowing down under "engine-brake" conditions, of coasting downhill, and of down-shifting.

The tendency of an engine to misfire is aggravated by extreme values of the air/fuel mixture. A mixture which is either too rich or too lean can misfire. A transient too-rich condition can occur during deceleration immediately after the engine throttle valve means is rapidly closed. At that moment, the pressure in the intake passage decreases abruptly. As a consequence, liquid fuel which was previously deposited on the wall surfaces of the intake passage is instantaneously vaporized, with the result that an excessively fuel-rich mixture is momentarily introduced into the combustion chamber, and can misfire. A transient too-lean condition can occur immediately after the foregoing too-rich condition (deceleration continuing), because then the pressure in the induction means is low (lower than at idle), and a conventional carburetor or fuel injector will supply a leaner-than-normal mixture because the amount of fuel supplied to it in response to the induction means pressure is more nearly related to air flow at idle conditions that it is to the more rapid air flow which occurs at deceleration conditions. Such a too-lean condition persists for the duration of the deceleration. In summary, under the first of these conditions, a too-rich, possibly misfiring, mixture will initially be supplied, and under the second, a too-lean, possibly misfiring, mixture will be supplied.

Also, the tendency to misfire is related to the "residual fraction". This term is defined as follows:

$$\text{Residual fraction} = \frac{\text{Amount of residual gases remaining in combustion chamber from previous cycle}}{\text{Amount of air (or air/fuel mixture) taken into combustion chamber for next cycle} + \text{Amount of residual gases remaining in combustion chamber from previous cycle}}$$

The term "amount" refers to weight, or to volume measured at like temperature and pressure. As the numerical value of the residual fraction decreases, so also does the tendency of the engine to misfire.

The induction means pressure is low under deceleration conditions. It is a fact that, as the pressure in the induction means decreases, the residual fraction, and the tendency to misfire, increase. Accordingly, the mixture under these conditions should be enriched. By enriching it, the possibility of misfiring because of the tendency of the residual fraction to increase is opposed.

By preventing misfiring, the oxidation of the fuel to consume the available oxygen tends primarily to be completed in the combustion chamber, and a relatively inexpensive, small and simple exhaust gas reactor can be used, because the thermal load on it is minimal, and it is not subjected to excessive thermal stress.

In addition, to protect the exhaust gas reactor in case of malfunction of the mechanism which prevents misfiring, means responsive to an excessive temperature can be provided for enriching the air/fuel mixture.

The present invention comprises an induction means, a throttle, a combustion chamber, an exhaust conduit, and an exhaust gas reactor in the exhaust conduit downstream from the combustion chamber. Means is not provided to supply air directly to the exhaust conduit. Means is provided for controlling the air/fuel ratio of a mixture supplied to the combustion chamber of an engine set to operate normally on a lean air/fuel mixture to prevent misfiring and consequent excessive thermal load on the exhaust gas reactor under deceleration conditions. According to the preferred method of the present invention, under deceleration conditions, mixture supplied to the combustion chamber is at first leaned for a limited time and, after a predetermined time, is enriched to produce under both circumstances a mixture having an air/fuel ratio on which mixture the engine tends not to misfire under deceleration conditions. As a consequence, the engine operates smoothly in this transient condition (deceleration), and the exhaust gas reactor is protected. The exhaust gas reactor requires no protection under normal load conditions, because the engine operates smoothly and without misfiring on a lean mixture under these conditions.

According to a preferred but optional feature of the invention, a supplementary air valve is provided which is responsive to pressure in the induction means, whereby to supply supplementary air for a limited time to the mixture in the induction means when the throttle is first closed under deceleration conditions.

According to another preferred but optional feature of the invention, the carburetor may be provided with a fuel nozzle controlled by a valve which is adapted to be opened at an induction means pressure which is respective to deceleration conditions, and supply additional fuel. Alternatively, the carburetor may include a low load fuel circuit with air-bleed means responsive to such conditions, or starter nozzle means may be utilized for supplying the additional fuel. As a further alternative, a source of air provided under normal conditions may be terminated during deceleration conditions.

According to yet another optional feature of the invention, the engine ignition may be advanced under deceleration conditions, thereby to improve combustion of the lean mixture and further to suppress any tendency to misfire.

Despitie the aforementioned features, or perhaps because of their malfunction, momentary misfiring might still occur in the engine, which could cause an excessive thermal load to be exerted on the exhaust gas reactor. Therefore, according to still another optional feature of this invention, thermosensitive means responsive to the temperature of the reactor is provided to enrich the mixture in the induction means when the temperature of the reactor reaches a critical value. This reduces the tendency of the engine to misfire, because misfiring is less likely to occur with richer mixtures than with leaner mixtures. Also, residual oxygen in the exhaust gas will be decreased, because the additional fuel will have consumed it before it reaches the exhaust gas reactor. Less oxidation then occurs in the reactor, and it is kept at a safe temperature.

This invention will be fully understood from the following detailed description and the accompanying drawings in which.

Figure 4:
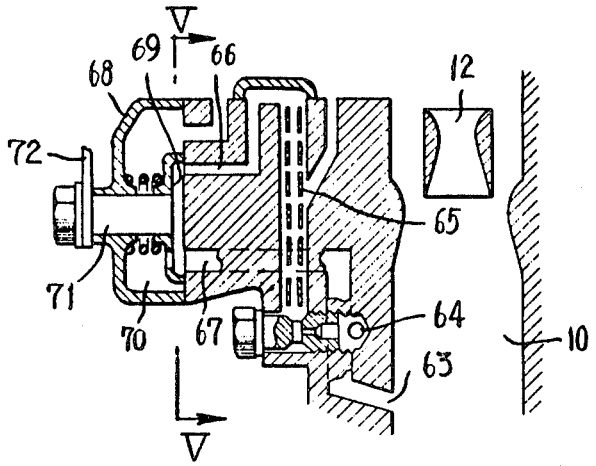
FIG. 4 is a fragmentary view of a portion of FIG. 3.
Figure 5B:
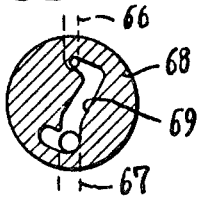
Figure 5A:
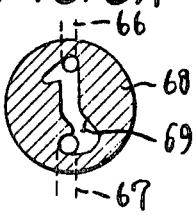
Figure 6:
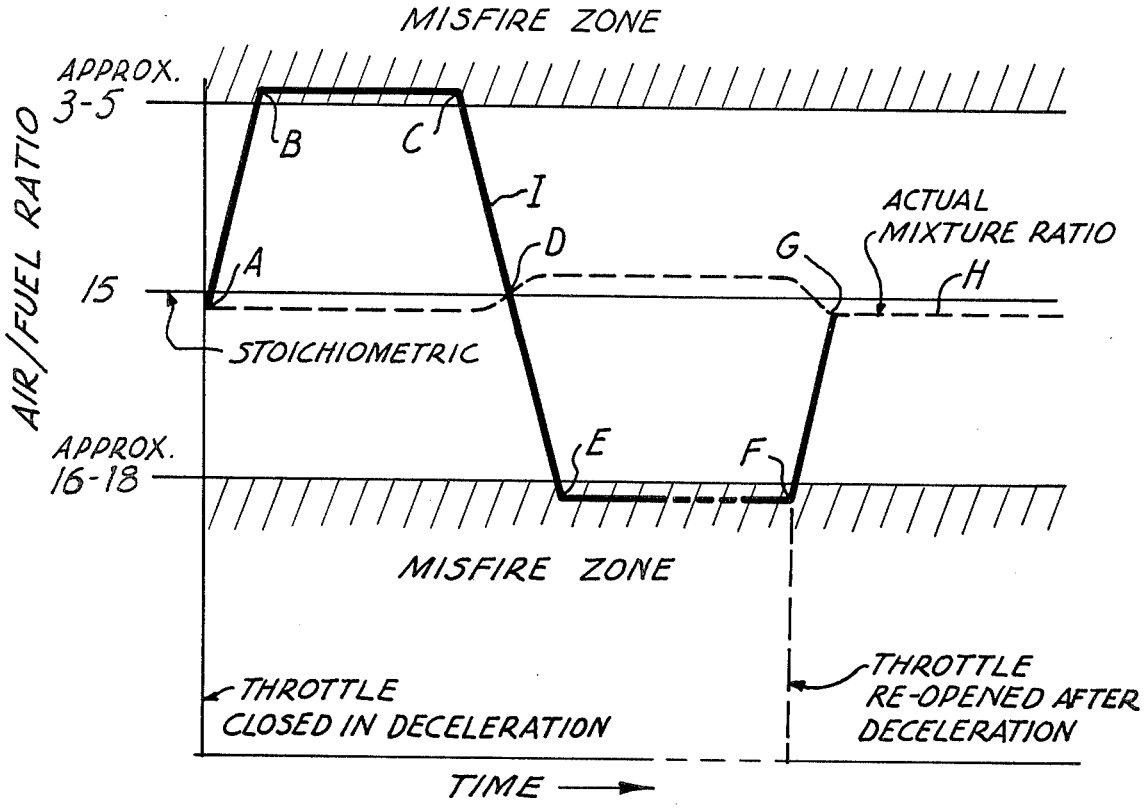

FIGS. 5*a* and 5*b* are fragmentary views of a control in two different positions taken at lines 5—5 in FIG. 4; and FIG. 6 is a schematic drawing illustating the theory of this invention.

Figure 1:
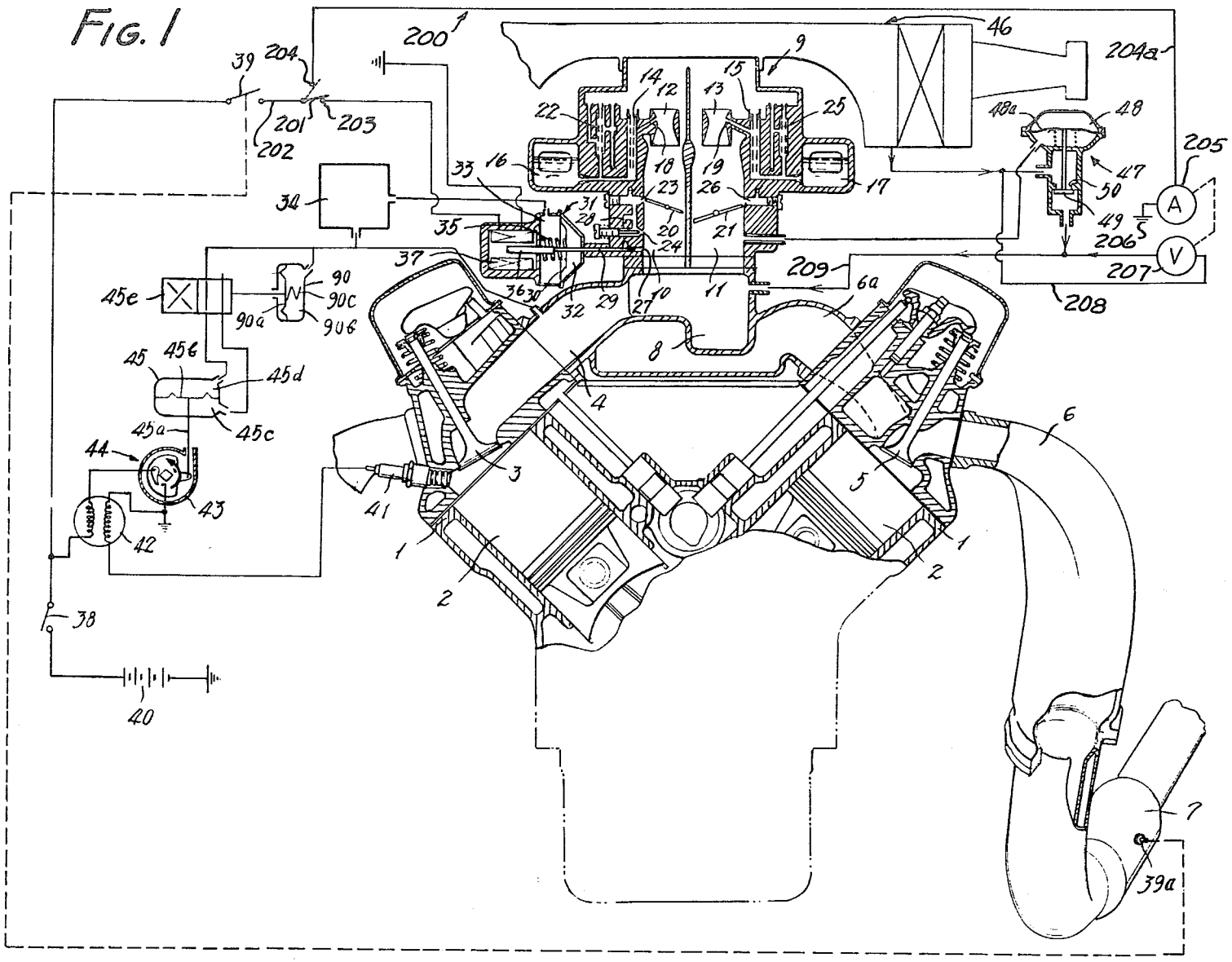
FIG. 1 is a side elevation, partly in cutaway cross-section and partly in schematic notation, of an engine incorporating the invention.

In FIG. 1 the invention is applied to a four-cycle internal combustion engine having a V-shaped arrangement of cylinders 1. Each cylinder includes a combustion chamber 2 which is connected through intake valve means 3 to an intake passage 4. Each combustion chamber is also connected through an exhaust valve means 5 to an exhaust pipe or conduit 6. The intake passage comprises induction means to supply a charge to be ignited in the combustion chamber. The exhaust condition comprises exhaust means to carry away the spent charge from the combustion chamber.

In exhaust conduit 6, there is disposed an exhaust gas reactor 7. Exhaust gases flow through it. The catalytic type may have a conventional catalytic structure with a skeleton (not shown) of heat-resistant ceramic material having a catalyst deposited thereon. Its purpose is to accelerate by catalysis the oxidation of unburned constituents of the fuel by the oxygen. The thermal reactor is a chamber of suitable size and dimensions, such that the exhaust gases reside therein for a period of time sufficient for the oxidation to occur. Either type may be used in this system.

There is no direct supply of air to the exhaust conduit. It communicates with the atmosphere only downstream from the exhaust gas reactor, where it discharges the spent gases to atmosphere. The particular type of catalytic element or even of exhaust gas reactor used is immaterial to this invention. Any type may be used provided that conditions are provided which are conducive to the oxidation of the unburned constituents.

The intake passage 4 for each of the combustion chambers is connected to an intake manifold 8 which in turn is in fluid communication with a carburetor 9. The carburetor 9 shown in the drawing is a two-barrel type having a primary and a secondary bore or barrel 10 and 11, respectively. Bores 10 and 11 are respectively provided with venturi elements 12 and 13. The venturi elements are respectively provided with main fuel nozzles 18 and 19 connected through air-bleed means 14 and 15 to float chambers 16 and 17, respectively.

Primary bore 10 is provided with a throttle valve 20. It has two slow ports 23 and 24, that are connected through an air-bleed 22 to the float chamber 16. Similarly, the secondary bore 11 is provided with a throttle valve 21 and has a port 26 opening into the passage through the wall thereof. Port 26 is connected through an air-bleed 25 to the float chamber 17.

Throttle valve 21 is normally in the illustrated fully-closed position so that only the primary side of the carburetor is brought into operation at relatively low and normal load operation. During high load operations, the throttle valve 21 is opened after the throttle valve 20 is fully opened so that both the primary and the secondary side of the carburetor are brought into operation. A portion of the exhaust pipe is extended as shown by **6*a* in the drawing to a position beneath intake manifold 8 so as to direct a portion of the exhaust gas thereinto to preheat the intake air in manifold 8**. This carburetor is set to provide a lean air/fuel mixture at normal conditions.

In the illustrated embodiment, a supplementary fuel port 27 is formed in bore 10. Port 27 is also connected through a passage 28 to the slow port 23. For controlling fluid flow through the supplementary fuel port 27, a needle valve 29 is secured to a diaphragm 30 of diaphragm means 31. Diaphragm 30 divides the interior of the diaphragm means 31 into an atmospheric pressure chamber 32 and a suction pressure chamber 33. Chamber 33 is connected through a suction pressure surge tank 34 to intake passage 4.

Needle valve 29 is normally biased toward the right in FIG. 1 under the influence of a spring 35 so as normally to close port 27. It is displaced toward the left by diaphragm means 31 so as to open port 27 when the suction (vacuum) pressure in intake passage 4 is reduced to some predetermined value.

An armature 36 is formed at one end of needle valve 29. A solenoid coil 37 surrounds the armature to form a solenoid means. The solenoid coil 37 includes wiring which is connected through an ignition switch 38 and a thermoswitch 39 to an electric power source 40.

Thermoswitch 39 is controlled by a heat-sensitive element **39*a* disposed in the exhaust conduit so as to sense the temperature of the exhaust gas reactor. Thermoswitch 39** is closed when the temperature of the exhaust gas reactor reaches a predetermined upper value.

The ignition system of the engine includes a distributor 43 for controllling ignition coil means 42 connected to ignition plugs 41. The distributor 43 has spark advance means 44 that is connected to diaphragm means 45. Diaphragm means 45 is adapted to be actuated by suction in the intake passage. Diaphragm means 45 includes a diaphragm **45*b* connected through a connecting rod 45*a* to the distributor 43. Chambers 45*c* and 45*d* are formed on opposite sides of diaphragm 45*b* which are selectively connectible to intake passage 4 through valve 45*a*. Valve 45*e* serves alternately to connect one or the other of chambers 45*c* and 45*d* to intake passage 4**, and the remaining one to the atmosphere.

Diaphragm means 90 for controlling valve **45*e* includes a diaphragm 90*a* which is connected to valve 45*e*. The diaphragm thereby acts as an actuator for valve 45*e*. A chamber 90*b* defined at the right side of the diaphragm 90*a* is connected to intake passage 4. A return spring 90*c* is provided in the chamber 90*b*. Diaphragm means 90 is actuated by suction to intake passage 4. During idling operation, the pressure in the intake passage 4, while subatmospheric, is not at the lowest operating level of the intake passage. The pressure at deceleration conditions is lower. At idling pressures diaphragm 90*a* is urged toward the left in FIG. 1 under the influence of spring 90*c* so as to set valve 45*e* to the setting shown in the drawing. Suction in the intake passage 4 is then introduced into the chamber 45*d* to move the diaphragm 45*b* upwardly in FIG. 1. The distributor 43** will thereby be rotated counterclockwise to retard the ignition timing.

During deceleration, the suction in the intake passage 4 is increased (i.e., the pressure is still lower) from the pressure which existed during the idling operation. The condition of valve **45*e* is then reversed so as to communicate the suction from intake passage 4 into chamber 45*c* instead of into chamber 45*d*. This is a substantial suction, and moves diaphragm 45*b* and rod 45*a*** downwardly. The distributor is thereby rotated clockwise so that ignition timing is advanced, perhaps 35° to 45° before top dead center. This occurs when the intake suction reaches a predetermined value characteristic of deceleration conditions. Advancement of the ignition timing tends to repress the tendency to misfire.

In the illustrated engine, the throttle valve 20 is opened to some extent even during idling operation. It allows a certain amount of mixture to flow into the combustion chamber. This increases the rate at which air/fuel mixture ("charge") is supplied to the combustion chambers during idling operation. In order to prevent the idling engine speed from being undesirably rapid due to this increased flow of intake mixture, the ignition timing is retarded. As previously described, when the intake pressure reaches a predetermined suitably low value ("high suction" or "high vacuum"), the diaphragm means 45 is operated to move spark advance means 44 in the ignition-retarding direction. Thereby it is possible to maintain a relatively low idling speed, even though a relatively large amount of intake mixture is introduced into the cylinders.

During normal, relatively low load, operation of the engine, only the throttle valve 20 is opened, and mixture is principally introduced through the primary bore 10. During high load (also normal) operation, the throttle valve 20 is fully opened, and the throttle valve 21 is also opened, so that the mixture is introduced through both of bores 10 and 11.

At this point it will be observed that a carburetor is only one means for supplying fuel for the air/fuel mixture. A fuel injector is another. Both will inject fuel into the intake manifold or other induction means upstream from the combustion chambers and downstream from the throttle in response to pressure in the induction means. They are fully equivalent.

As previously described, a fuel-lean mixture is introduced into the engine combustion chambers 2 to fuel the engine at normal conditions, and the exhaust gas will therefore include a certain amount of residual oxygen. The exhaust gas, including any unburned constituents, flows through the exhaust conduit, where it enters the exhaust gas reactor, there to contact the catalytic element when a catalytic reactor is used, or to reside in the chamber of thermal reactor long enough for oxidation to occur, depending on which type is used.

The unburned constituents are oxidized by the residual oxygen. Because it utilizes oxygen which is present in the spent lean charge from the combustion chambers when the engine is not decelerating, the process in the exhaust gas reactor does not require supplementary air from the atmosphere, and because the mixture is initially lean, there is little to oxidize. Therefore, no means is needed to inject air directly into the exhaust conduit, and the exhaust gas reactor can be of minimum size and complexity.

However, under deceleration conditions, there is a time when additional air is needed. Means is provided to supply this air to the induction means upstream from the combustion chambers. An air cleaner 46 is placed upstream from the inlet portion of the carburetor 9. For the said purpose, a supplementary air valve 47 forms a bypass for air flow between air cleaner 46 and intake manifold 8.

During deceleration, an abrupt decrease in pressure occurs immediately after the closure of the throttle valve. Because of this, fuel which was deposited on the intake passage wall during normal operation will spontaneously be vaporized. Therefore, an excessively fuel-rich mixture momentarily be introduced into the combustion chambers which could misfire. Valve 47 serves to supply additional air to the intake passage during this time to dilute the mixture and to maintain the ratio at a value which will not cause misfire.

Valve 47 includes a valve member 49 secured to the diaphragm 48, and a valve bore 50. Flow through the bore is controlled by valve member 49. Diaphragm 48 is subjected to the intake pressure at the downstream side of the throttle valve 21. During deceleration, diaphragm 48 is actuated by the intake pressure (which is sub-atmospheric) to move valve member 49 and open valve bore 50. Thus, supplementary air is supplied from the air cleaner 46 to the intake manifold. Diaphragm 48 is pierced by an aperture **48*a* so that the diaphragm tends to return to its original position after the conclusion of a suitable time delay following closure of the throttle valve. The size of this orifice or aperture is selected to provide the desired time delay. The larger it is, the smaller the delay. Valve bore 50 will then be closed by the valve member 49** to terminate the supply of additional air.

After the above-described initial rich event, the mixture becomes too lean. This is because a conventional carburetion means (carburetor or fuel injector) responds to the low induction pressure of deceleration much as it would to an idling demand, and the amount of fuel supplied by it is insufficient to create, with the more rapid flow of air, a suitable non-misfiring mixture. Therefore, the mixture ratio must be changed, and a convenient means to do so is to supply additional fuel and to maintain the mixture ratio at a suitable value. For this purpose, suction in intake passage 4 is transmitted through surge tank 34 into suction chamber 33 of the diaphragm means 31. Diaphragm 30 moves toward the left, and moves needle valve 29 to open the supplementary fuel port 27. The construction is such that this movement involves a time delay, for example about 1 to 2 seconds after the throttle valves are closed. The delay can be selected by selecting an appropriate size of surge tank, or by placing a restrictor or orifice in the lines. The system is adjusted so that supplementary ("additional") fuel starts about the time the supplementary ("additive") air stops.

Additional fuel is supplied from bore 10 through manifold 8 and intake passage 4 to the combustion chamber 2. The supply of supplementary fuel is continued for the duration of the deceleration operation. The numerical value of the air/fuel ratio to be maintained will be discussed below. It is such that misfiring is averted. The oxygen in the intake mixture will be substantially consumed in the combustion chamber. A combustible mixture does not reach the exhaust gas reactor where combustion catalyzed by it might impose a thermal overload. Oxidation at the exhaust gas reactor is suppressed due to the lack of oxygen to maintain the oxidation. This protects the exhaust gas reactor from being subjected to an excessive thermal load, and enhances its durability, regardless of which type of reactor is used.

During operation of the engine, despite the usage of the features of this invention, or perhaps because of a momentary malfunction of them, misfiring might occur. Then, unless care were taken, unburned mixture would reach the exhaust gas reactor, and the fuel would be oxidized therein, perhaps exerting an excessive thermal load on it. This can be opposed by supplying additional fuel to the induction means so that the oxygen will somehow be consumed before the mixture reaches the catalytic element, and perhaps also by preventing misfiring.

To detect excessive temperature and reverse the tendency to overheat, thermoswitch 39 will be closed when the exhaust gas reactor reaches a predetermined critical temperature so as to energize the solenoid 37 and move the needle valve 29 toward the left in FIG. 1. This will open the supplementary fuel port 28 and provide supplementary fuel to the charge. The exhaust gas reaching the exhaust gas reactor will then be substantially free from residual oxygen, and oxidation of fuel in the exhaust gas reactor will be suppressed. The temperature of the catalyst will thereby be maintained at a safe level.

An alternate means to provide this thermal overload protection is illustrated as a circuit 200, also under the control of thermoswitch **39*a*. To show that it is an alternative construction, the common terminal of a selector switch 201 is connected to lead 202. One terminal 203 is connected to winding 37. Terminal 204 is connected to lead 204*a*. Lead 204*a* connects to a valve actuator 205 which is grounded at 206. This valve actuator, when actuated, closes normally-open air valve 207. Valve 207 supplies air to the induction system through air conduits 208 and 209 from the air cleaner, bypassing the carburetor under normal operating conditions. Air from these conduits forms part of the mixture under normal conditions. The carburetor is set to provide a lean mixture with air passed by the throttle and by this valve. When the mixture is to be enriched in response to overheating in the reactor, switch 39 is closed, and actuator 205 closes air valve 206. This will enrich the mixture. It is obvious that any carburetor would be differently set for each of the two settings of selector switch 201, and that in practice only one of these systems will be used on any engine. The two are shown on this engine solely for purposes of illustration of the two embodiments. The solid-line setting of switch 201** is for the preferred system. The dotted-line setting is for the alternative system just described.

Figure 2:
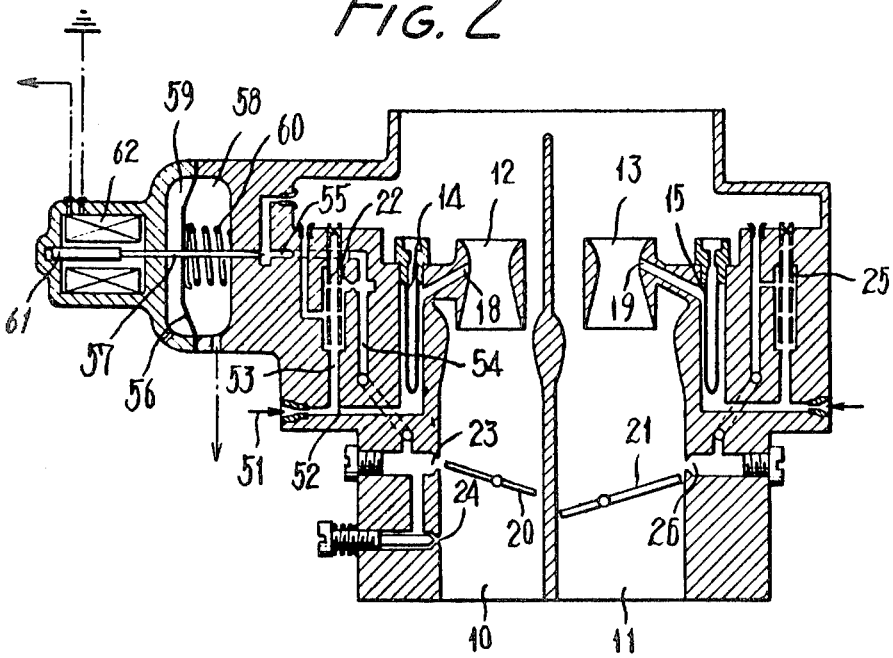
FIG. 2 is an axial section of a modified form of carburetor useful with this invention.

FIG. 2 shows an example in which the supply of supplementary fuel is made by utilizing slow speed ports in the carburetor. In all of the Figs., corresponding parts are shown by the same reference numbers as in the other embodiments. As shown by arrow 51, fuel from the primary float chamber (not shown) is introduced into a passage 52 and passed through an air-bleed 14 into a main fuel nozzle 18 to be discharged into the venturi element 12. Passage 52 is provided with a branch passage 53 which is connected to a passage 54 leading to slow ports 23 and 24. Further, the passage 54 is connected to a diluting air passage 55. The fuel introduced from the air-bleed 22 into the passage 54 is diluted by air from passage 55 and is discharged from slow ports 23 and 24 into bore 10.

Air passage 55 is provided with a needle valve 57 secured to a diaphragm 56. At the right side of diaphragm 56, there is defined a suction pressure chamber 58, into which the pressure (usually sub-atmospheric) in the intake passage is introduced. A atmospheric pressure chamber 59 is defined at the opposite side of the diaphragm. A return spring 60 normally urges the diaphragm 56 and the needle valve 57 toward the left in FIG. 2 to open passage 55. When a sufficient suction is produced in the intake passage, diaphragm 56 is moved to the right so needle valve 57 will close passage 55. When passage 55 is closed, the supply of supplementary air into the passage 54 is terminated. Valve 57 therefore comprises a "supplementary fuel valve", because an increased amount of fuel is discharged from the slow ports 23 and 24 into the bore 10 as a consequence of its action. Needle valve 57 is provided with an armature 61 for cooperation with a solenoid 62 that is controlled by a thermoswitch (not shown). It functions in the same way as the solenoid 37 in the previous embodiment.

Figure 3:
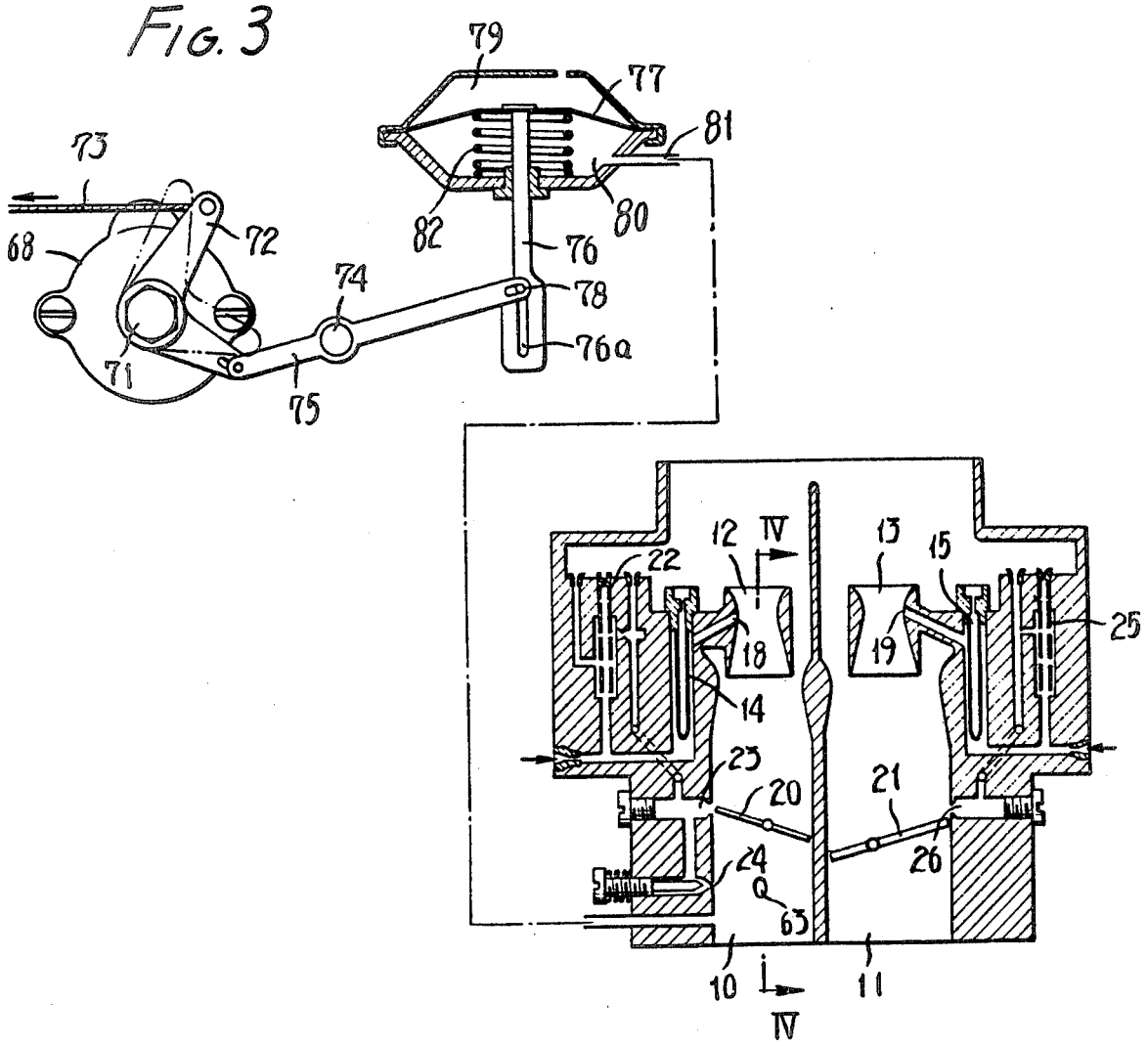
FIG. 3 is an axial section, partly in schematic notation, showing another embodiment of the invention.

FIGS. 3 and 4 show an embodiment in which a starter fuel nozzle is used for supplying supplementary fuel. Primary bore 10 includes a starter nozzle 63 which opens through the wall surface thereof to discharge fuel at a level substantially aligned with the slow port 24. The starter nozzle 63 is connected through an air-bleed 65 (see FIG. 4) and passages 66 and 67 to a passage 64 communicating with the float chamber 16. A valve 68 is provided between the passages 66 and 67. Valve 68 has a valve passage 69 and an air-bleed passage 70, as shown in FIG. 4. It has a rotatable part which rotates between one position in which passages 66 and 67 are connected together and fully open to one another, and another position in which such interconnection is interrupted or restricted. A shaft 71 is secured to valve 68.

An L-shaped lever 72 is secured to shaft 71 (see FIG. 3). One of the ends of lever 72 is connected to a starter cable 73 that is adapted to be pulled by an operator in the direction shown by an arrow during engine start-up to move the valve 68 into the full-open position shown in FIG. 5A and to connect passage 66 and 67 together. The other end of lever 72 is connected to one end of a lever 75 which is pivoted by a pivot 74. The other end of lever 75 carries a pin 78 which engages in a slot **76*a* of an actuating rod 76 secured to a diaphragm 77**.

An atmospheric pressure chamber 79 is defined at the upper side of the diaphragm 77. A suction pressure chamber 80 is defined at the other side of the diaphragm. Suction pressure chamber 80 is connected through a line 81 to the bore 10 at the downstream side of throttle valve 20. A return spring 82 is provided for normally biasing diaphragm 77 and upwardly in FIG. 3.

When the pressure in bore 10 is sufficiently decreased, diaphragm 77 moves downwardly to rotate the lever clockwise so that valve 68 is opened by only a small amount (see FIG. 5B). Passages 66 and 67 are connected together, and supplementary fuel is discharged through starter nozzle 64. It is, of course, possible to combine a solenoid device with rod 76 of diaphragm 77, as in the previous embodiments, instead of using the diaphragm-type element. The amount of angular displacement of valve 68 while the valve functions as a supplementary fuel valve may be different from the setting during engine start-up, thereby to control the amount of fuel supplied by the starter circuit at different conditions.

In all of the foregoing embodiments, the pressure which is effective to cause the control means to supply supplementary fuel or air is one which is characteristic of deceleration conditions. The relatively higher pressures (lower vacuum) of idling conditions or of low load operations do not cause the supplementary air or fuel to be supplied.

The embodiment of FIGS. 2–5 may be directly substituted for their equivalent valves and control means in FIG. 1, where their function to provide supplementary fuel is identical.

FIG. 6 illustrates the method of the invention, and certain of its quantitative aspects. This graph shows the changes in the air/fuel ratio downstream from a carburetor, or from a fuel injection means which feeds fuel at rates similar to those supplied by a carburetor, as a function of time from the moment the throttle is closed at the start of a deceleration, until the throttle is reopened and the engine resumes normal non-decelerating operations.

The graph further illustrates that in a conventional, practical engine, air/fuel ratios having a numerical value less than between about 3 to 5 and greater than between about 16 to 18 in conventional engines (and about 25 to 28 in some engines which are especially adapted for lean operation) tend to misire. The values on the graph are for the more conventional engine, and the vertical scale of the graph is somewhat disproportionate. With the substitution of the numbers 25–28 for 16–18 in FIG. 6, the graph is correct and to scale for engines adapted for still leaner operation. The theory is the same, whatever the values. At least theoretically, if the ratio were kept between these limiting values, misfiring should not occur. However, the residual fraction becomes an important consideration under deceleration conditions, and accordingly, it is preferred for the actual mixture ratio to be no greater than about 15 to 16 to be more certain of avoiding misfiring. In a practical engine, adapted for operation on a lean mixture, ratios between about 16–20 are used for normal operations. Under deceleration conditions, values between about 14 to about 16 are preferably utilized, although numbers approaching 5 may also be used. It is advantageous to remain reasonably close to stoichiometric, and preferably on the lean side thereof, because when lean mixtures are used, the hydrocarbons will be optimally oxidized at the exhaust gas reactor without regarding additional oxygen.

In FIG. 6 the engine is initially set to utilize a mixture having an air/fuel ratio of about 16, although in some engines it may be leaner, such as about 20. Line segments AB and BC illustrate what the situation would be when the throttle is first closed if the invention is not used. It shows the initial enrichment of the mixture resulting from the evaporation of the fuel film. At point C, this film will have been removed, and the mixture would become excessivdely lean as shown by segments CE and EF. Segment EF is of indefinite length and duration. It would endure as long as the engine operates under deceleration conditions.

Point F represents the point in time when the throttle is reopened to establish normal load conditions. Then the mixture tends to revert to the regular lean value (point G).

The above wide swings into the misfire zones illustrate why an exhaust gas reactor can be thermally overstressed as a consequence of misfiring at deceleration conditions, because an unburned oxidizable mixture is dumped into it, and it oxidizes there. This load can raise the temperature of a thermal reactor to an unacceptably high value, and the thermal reactor would have to be made of expensive material to resist it. Similarly, a delicate or lightweight catalytic element could readily be cracked by the thermal stress. With this invention, the thermal overload can be averted, and temperatures below about 850° C. can be assured. Then the reactors can be lightweight and be made from relatively inexpensive materials.

Supplementary air is added during the period illustrated between point A and about point C. The length of time is relatively constant for a given engine, and the air-bleed will be set to establish this period. Also, the mechanism to provide supplementary fuel will be so constructed as to require about the same time before it supplies supplementary fuel, which it does at the time illustrated at about point D. The supply of supplementary fuel continues until the time illustrated by point F, at which it terminates.

The resulting actual mixture ratio is shown by dashed line H. It tends to stay on the lean side of stoichiometric between points A and D, and may (but need not) be richer for the time between point D and about point G. The feature emphasized here is that the ratio is changed from the undesirable misfiring ones shown by line I to that shown by line H where misfiring does not occur, and the temperature in the exhaust gas reactor is prevented from reaching unacceptably high values.

It will be appreciated that the initial "leaning" of the mixture in the induction means (i.e., an increase in the numerical value of the air/fuel ratio compared to what the value would be if means to lean the mixture were not provided) can be accomplished either by providing supplementary air or by redcuing the supply of fuel. The control of supplementary air is the more convenient technique. Also, the "enrichment" of the mixture in the induction means (i.e., a decrease in the numerical value of the air/fuel ratio compared to what the value would be if the means to enrich the mixture were not provided) can be accomplished either by increasing the supply of fuel, or by decreasing a supply of air, during deceleration and also whenever the thermal control causes the enrichment to occur.

Those systems which cause the mixture to be richer are sometimes referred to as "means for enriching the mixture in the induction means". Those systems which cause the mixture to be leaner are sometimes referred to as "means for leaning the mixture in the induction means", without distinction as to whether they increase or decrease the fuel or the air. Control is exerted over the ratio, and adequate supply of mixture to operate the engine is presumed.

As described above, and according to the present invention, the exhaust conduit is not directly in communication with the atmosphere, and the system operates without pumps or bypass means to the exhaust gas reactor. The catalytic element or reactor chamber is upstream from the discharge end of the exhaust conduit. Unburned constituents in the exhaust gas will therefore be oxidized only by residual oxygen contained in the exhaust gas itself.

Controlling the tendency of the engine to misfire by regulating the air/fuel mixture ratio in turn regulates the constituents of the gases which reach the exhaust gas reactor, and especially limits the amount of oxygen therein which is available for oxidation. As a consequence, excessive thermal stress is averted. Therefore, the benefits of lean engine operation, and of either catalytic exhaust elements or thermal reactors, can advantageously be attained with the use of elegantly simple, reliable means, and relatively inexpensively.

This invention is not to be limited by the embodiments shown in the drawings and described in the description, which are given by way of example and not of limitation, but only in accordance with the scope of the appended claims.

We claim:

1. In a four-stroke, spark ignition, internal combustion engine adapted to utilize for operating conditions other than deceleration an air/fuel charge which is not richer than stoichiometric derived from a fuel supply means which delivers a fuel/air mixture that is not richer than stoichiometric, said engine being of the type which includes a combustion chamber, induction means for receiving said mixture and introducing said charge to the combustion chamber, an exhaust conduit for removing spent charge from the combustion chamber, an exhaust gas reactor in the exhaust conduit, and a throttle valve controlling flow of air into the induction means, the improvement comprising: means for enriching the charge in the induction means; means to lean the charge in the induction means; control means responsive to pressure in the induction means characteristic of the closure of the throttle valve at deceleration conditions, said control means operatively effective on the means for leaning the charge by adjusting the amount of air or fuel in the induction means for a predetermined and limited time after said closure; and control means responsive to said pressure operatively effective on said means to enrich said charge in the induction means by adjusting the amount of air or fuel in the induction means after a delay from said closure so long as the said pressure persists.

2. Apparatus according to claim 1 in which thermosensitive means responsive to the temperature of the exhaust gas reactor exerts control over the said means for enriching the charge in order to enrich the charge when the said temperature reaches and exceeds a predetermined value and precludes oxygen from reaching the exhaust gas reactor, thereby to terminate oxidation in the reactor while it is overheated.

3. Apparatus according to claim 2 in which the means for enriching the charge comprises a supplementary air supply which is reduced to enrich the charge.

4. In a four-stroke, spark ignition, internal combustion engine adapted to utilize for operating conditions other than deceleration an air/fuel charge which is not richer than stoichiometric derived from a fuel supply means which delivers a fuel/air mixture that is not richer than stoichiometric, said engine being of the type which includes a combustion chamber, induction means for receiving said mixture and introducing said charge to the combustion chamber, an exhaust conduit for removing spent charge from the combustion chamber, an exhaust gas reactor in the exhaust conduit, and a throttle valve controlling flow of air into the induction means, the improvement comprising: means for introducing supplementary fuel into said induction means; means for introducing supplementary air into said induction means; control means responsive to pressure in the induction means characteristic of the closure of the throttle valve at deceleration conditions, said control means operationally effective on the means for supplying supplementary air to cause it to supply supplementary air to the induction means for a predetermined and limited time after said throttle closure; and control means responsive to said pressure operationally effective on said means to supply supplementary fuel to the induction means to cause it to supply supplementary fuel after a delay from said closure so long as the said pressure persists.

5. Apparatus according to claim 4 in which thermosensitive means responsive to the temperature of the exhaust gas reactor exerts operational control over the said means supplying supplementary fuel in order to supply supplementary fuel to the induction means while and so long as the said temperature is at or above a predetermined value and precludes substantial amounts of oxygen from reaching the exhaust gas reactor, thereby to terminate oxidation in the reactor while it is overheated.

6. Apparatus according to claim 4 in which ignition-advance means is provided which is responsive to said pressure for advancing the ignition under deceleration conditions.

7. Apparatus according to claim 4 in which the means for supplying supplementary air comprises an air conduit entering the induction means and a valve in said air conduit, and in which the respective control is a pressure-responsive valve actuator operationally responsive to pressure in the induction means, said valve actuator including means disabling it and closing said valve after said predetermined period of time while and so long as said characteristic pressure persists.

8. Apparatus according to claim 4 in which the means for supplying supplementary fuel comprises a fuel passage and a valve in the fuel passage, and in which the respective control is a pressure-responsive valve actuator operationally responsive to pressure in the induction means.

9. Apparatus according to claim 4 in which the means for supplying supplementary fuel is a fuel passage entering the induction means, a passage for dilution air, and a valve controlling flow of dilution air, and in which the respective control is a pressure-responsive valve actuator operationally responsive to pressure in the induction means.

10. Apparatus according to claim 4 in which the means for supplying supplementary fuel is a carburetor starting circuit including a valve controlling the flow of fuel therethrough, and in which the control means comprises a pressure-responsive valve operationally responsive to pressure in the induction means.

11. Apparatus according to claim 8 in which the means for supplying supplementary air comprises an air conduit entering the induction means and a valve in said air conduit, and in which the respective control is a pressure-responsive valve actuator operationally responsive to pressure in the induction means, said valve actuator including means disabling it and closing said valve after said predetermined period of time while and so long as said characteristic pressure persists.

12. Apparatus according to claim 9 in which the means for supplying supplementary air comprises an air conduit entering the induction means and a valve in said air conduit, and in which the respective control is a pressure-responsive valve actuator operationally responsive to pressure in the induction means, said valve actuator including means disabling it and closing said valve after a predetermined period of time while and so long as said characteristic pressure persists.

13. Apparatus according to claim 10 in which the means for supplying supplementary air comprises an air conduit entering the induction means and a valve in said air conduit, and in which the respective control is a pressure-responsive valve actuator operationally responsive to pressure in the induction means, said valve actuator including means disabling it and closing said valve after a predetermined period of time while and so long as said characteristic pressure persists.

* * * * *